United States Patent [19]

Hayashi et al.

[11] Patent Number: 4,559,171

[45] Date of Patent: Dec. 17, 1985

[54] HEATING PROCESS FOR SOLIDIFYING A CRUD

[75] Inventors: Masaru Hayashi, Tokyo; Tomoyuki Okumura, Nagoya, both of Japan

[73] Assignee: NGK Insulators, Ltd., Japan

[21] Appl. No.: 459,511

[22] Filed: Jan. 20, 1983

[30] Foreign Application Priority Data

Feb. 1, 1982 [JP] Japan ..... 57-13320

[51] Int. Cl.[4] ..... G21F 9/16

[52] U.S. Cl. ..... 252/629; 210/682; 210/734; 252/631; 252/633

[58] Field of Search ..... 252/629, 628, 631, 633, 252/632, 635; 423/11, 12; 210/733, 734, 735, 682, 683, 685, 688, 911, 912, 730, 731

[56] References Cited

U.S. PATENT DOCUMENTS

| | | | |
|---|---|---|---|
| 3,890,244 | 6/1975 | Carlin | 252/632 |
| 4,010,108 | 3/1977 | Gablin et al. | 252/628 |
| 4,156,646 | 5/1979 | Schulz | 252/631 |
| 4,167,491 | 9/1979 | Gablin et al. | 252/628 |
| 4,269,706 | 5/1981 | Sondermann | 423/12 |
| 4,299,722 | 11/1981 | Stock et al. | 252/628 |
| 4,330,409 | 5/1982 | Yong et al. | 210/731 |
| 4,342,653 | 8/1982 | Halverson | 210/734 |
| 4,376,070 | 3/1983 | Pope et al. | 252/629 |
| 4,377,507 | 3/1983 | Pope et al. | 252/629 |
| 4,377,508 | 3/1983 | Rothberg | 252/631 |

FOREIGN PATENT DOCUMENTS

| | | | |
|---|---|---|---|
| 0008880 | 4/1978 | Japan | 252/628 |

OTHER PUBLICATIONS

Ayres, ed., 1970, Decontamination of Nuclear Reactors and Equipment, Ronald Press Co., New York, pp. 54–55.

Atomic Energy of Canada Research Company, 1970, Review of In-Reactor Zircaloy Corrosion and Crud Deposition Experience at AECL.

*Primary Examiner*—John F. Terapane
*Assistant Examiner*—Howard J. Locker
*Attorney, Agent, or Firm*—Parkhurst & Oliff

[57] ABSTRACT

A radioactive waste is solidified by adding a nonionic high molecular flocculant to a slurry containing radioactivated crud to precipitate the crud, concentrate the thus treated slurry and then separating the crud from the slurry, drying said crud, mixing the dried crud with a frit of a low melting point and filling a steel can with the resulting mixture, heating the steel can to sinter and solidify the above described mixture, and sealing a surface of the solidified body in the steel can with a sealing material.

18 Claims, 1 Drawing Figure

HEATING PROCESS FOR SOLIDIFYING A CRUD

BACKGROUND OF THE INVENTION

1. Field of the Invention

The present invention relates to a treating process for solidifying a radioactive waste and more particularly to solidification by sintering crud (crud being an abbreviation for "Chalk River unidentified deposit" which has been found by the Chalk River nuclear laboratory in Canada and refers to the corroded products containing radio-activated Beta and Gamma nuclear species) formed in the cooling water system of a reactor.

2. Description of the Prior Art

In order to store for a long period of time, or dispose of a radioactive waste generated from a nuclear power plant etc., it is necessary to minimize the leakage and diffusion of radioactive substances into the environment. It is for this purpose that it has been generally attempted to transform the radioactive waste into a stable solidified body. Prior treating processes for solidifying the radioactive waste include mainly a cement-solidifying process, asphalt-solidifying process, plastics-solidifying process, glass-melt solidifying process and the like. However, the cement-solidifying process is low in its volume reducing ability. The asphalt-solidifying process uses a melted asphalt having a high temperature upon solidification, so that there are drawbacks that there happens to be a danger of fire and the water proofness of the solidified bodies is not sufficient. The plastics-solidifying process cannot be applied to a high level of radioactive waste. The glass-melt solidifying process needs to effect the treatment at a high temperature, so that a part of radioactive substances is volatilized and further, the volume reducing ability is poor.

In a primary cooling water system of a reactor in a nuclear power plant, oxides of iron, cobalt and the like or corroded products created on and scaled off from instruments or pipes of the primary cooling water system in a system for feeding water into a reactor are flowed into the reactor, together with the cooling water and stick to and deposit upon a surface of the fuel rod and are subsequently irradiated with neutrons on a surface of the fuel rod to form a radioactivated crud. This radioactivated deposited crud is dissolved off or scaled off and flows out of the reactor together with the cooling water and sticks on the system instruments, pipes and the like, so that a dosage rate of these instruments, pipes and the like is raised, whereby the operators, or the maintaining or controlling workers are exposed to the radioactivated crud. Therefore, the crud should be solidified to minimize such exposure. However, an adequate solidifying treatment has not been heretofore established with respect to a medium level or high level of radioactive waste in a slurry form, such as crud, so that such waste is stored in a tank as a crud slurry and it has been demanded that the process for treating the crud is found as early as possible.

SUMMARY OF THE INVENTION

The present invention lies in a treating process for solidifying a crud in which the crud of a medium level or high level of radioactive waste to which a treating process has never been heretofore established as mentioned above, is safely and surely solidified, which comprises precipitating and concentrating a radioactivated crud by adding a nonionic high molecular flocculant into a slurry containing said crud, separating the precipitated crud, drying the separated crud, mixing the dried crud with a frit of a low melting point having a softening temperature of lower than 500° C., filling the mixture in a steel can, sintering and solidifying the filled mixture by heating and sealing the solidified body surface with a sealing material.

That is, in the present invention, a slight amount of crud contained in the cooling water is concentrated and separated by adding a particularly defined flocculant and taken out as powder, and the powdery crud is mixed with a frit having a low melting point and the resulting mixture is heated and solidified in a steel can and the surface of the solidified body is tightly sealed with a sealing material, whereby a middle or high level of radioactive waste of crud is safely and surely solidified and treated.

DESCRIPTION OF THE PREFERRED EMBODIMENTS

Figure 1:
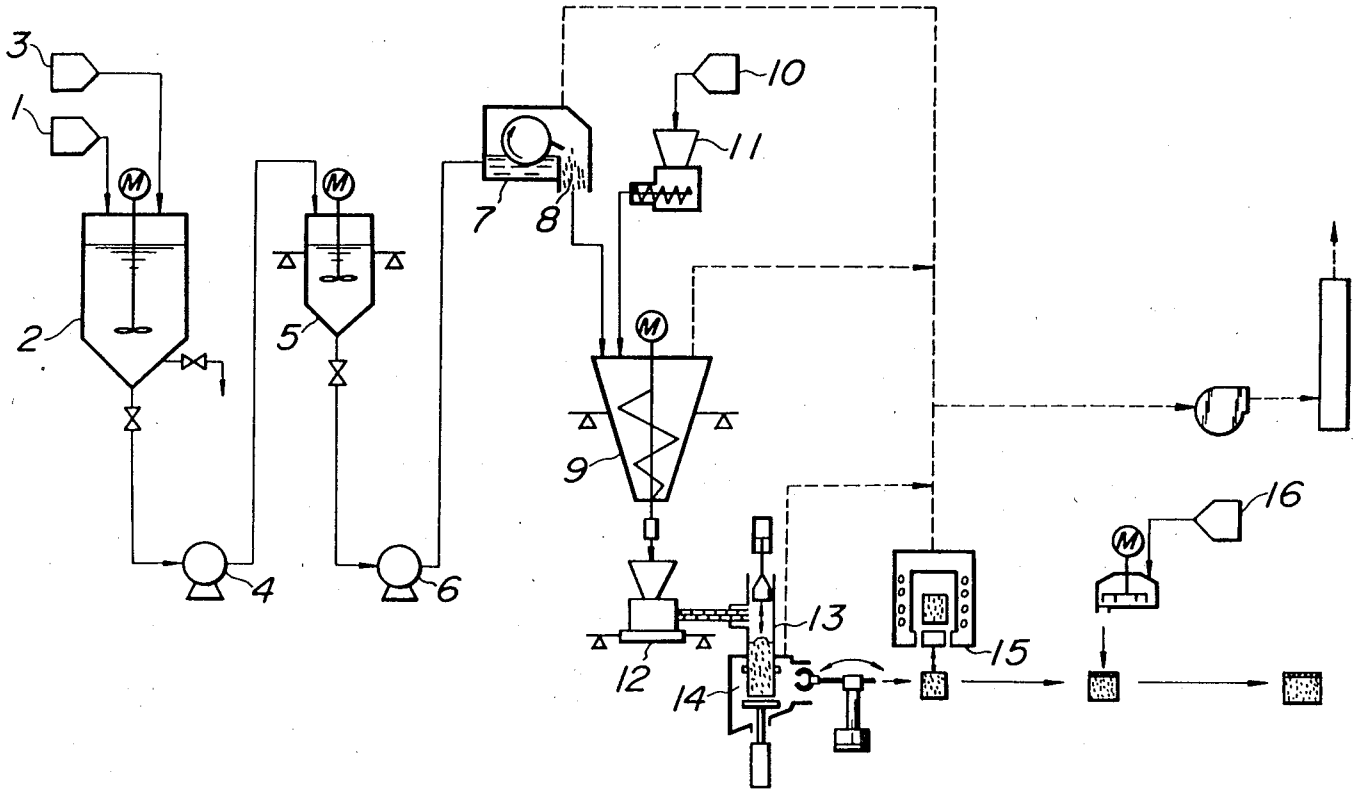
FIG. 1 is an explanatory view showing steps of one embodiment of the treating process of the present invention.

The present invention will be explained in more detail with reference to FIG. 1. A crud of radioactivated iron oxide etc. contained in the primary cooling water of a nuclear power plant is separated in a crud separator and fed into a slurry concentrating tank 2 as a crud slurry 1 having a crud concentration of 1–5%. In the slurry concentrating tank 2, a nonionic high molecular flocculant 3, for example polyacrylamide series of flocculant etc. is added thereto in an amount of 0.3–1.0 ppm, preferably about 0.5 ppm based on the slurry amount to precipitate the crud to concentrate the slurry into a slurry concentration of about 30–35%. The slurry then is fed into a slurry controlling tank 5 by a pump 4 for feeding the slurry and the slurry concentration is controlled to about 30% and the thus treated slurry is stored in the tank 5. Then, the controlled slurry is quantitatively supplied to a drum drier 7 heated with steam and the like by a metering pump 6 and the crud is dried therein to obtain powder.

The powdery crud 8 is quantitatively fed into a mixer 9 and a frit 10 of a low melting point having a softening point of less than 500° C., is added to the mixer 9 through a feeder 11, depending upon an amount of crud supplied and stirred and mixed for a given time. The mixed powder which has been thoroughly mixed in the mixer 7, is introduced into a filling compressing device 13 in a given metered amount through a feeder 12 and filled in a steel can 14 under pressure. The steel can 14 filled with the mixture is placed in a sintering furnace 15 and heated within a temperature range of 500°–800° C., preferably 600°–700° C., for 2–20 hours, preferably 15–20 hours, to sinter the crud to obtain a solidified body.

The sintering temperature should be not lower than 500° C., because the frit has a melting point of lower than 500° C., while if said temperature is higher than 800° C., many pores are formed in the solidified crud body and as a result, the compression strength lowers and the radioactive substance can be leaked and diffused.

The sintering time is determined by taking the following points into consideration. It is desirable that the mixture of the crud and the frit is gradually heated so as to uniformly sinter the mixture including the interior and said time needs to be at least 2 hours at the above described temperature. On the one hand, the treatment of the crud is generally effected in batch operation, so that it is preferable to effect the sintering treatment within one day, that is 15–20 hours.

Then, the surface of the solidified body in the steel can is tightly sealed with a sealing material 16, such as glass, cement and the like.

In the embodiment shown in FIG. 1, the concentrated crud slurry is controlled in the slurry controlling tank 5 but this slurry controlling tank 5 is not always necessary because the concentrated slurry may be directly fed to the drier and dried therein. As the drier for drying the slurry, the drum drier is preferable, because the continuous drying is feasible but other type of driers are also acceptable. It is important that the apparatus for carrying out the present invention is a closed structure to avoid the exposure of anyone to radioactivity.

The reason why the nonionic high molecular flocculant is used for concentrating of the crud slurry in the present invention, is based on the fact that iron oxide etc. is the main component of the crud, and the same are not substantially ionized and therefore are chemically substantially neutral.

The reason for limiting the concentration of the flocculant to 0.3–1.0 ppm, preferably 0.5 ppm is as follows.

As an amount of the flocculant added to the crud slurry is increased, the precipitating rate is increased and the crud concentration in the supernatant liquid becomes lower but the concentration of the precipitating slurry becomes lower. However, the concentration of the precipitating slurry is preferred to be greater than 30% when the precipitating slurry is dried in the next step, so that the concentration of the flocculant must be not more than 1 ppm. On the other hand, if the concentration of the flocculant is less than 0.3 ppm, the precipitating rate of the slurry becomes low and non-precipitated crud remains in the supernatant liquid.

The reason why the frit of a low melting point having a softening temperature of lower than 500° C., is used, which is most characteristic in the present invention, is based on the fact that the frit having a softening temperature of higher than 500° C. causes volatilization of radioactive substances and is not desirable. Further the durable life of the heating apparatus becomes short. As one composition of a frit of a low melting point having a softening temperature of lower than 500° C. to be used in the present invention, aluminum phosphate series of frit as shown in Table 1 is effective.

TABLE 1

| Composition | $Al_2O_3$ | $B_2O_3$ | $Na_2O$ | $P_2O_5$ | other |
|---|---|---|---|---|---|
| ratio (by weight percent) | 10–20 | 30–40 | 10–20 | 30–40 | 10–20 |

But the composition of the frit is not limited thereto and any frits having the softening temperature of lower than 500° C. are acceptable. The mixing ratio of the frit of a low melting point having a softening temperature of lower than 500° C. with the powdery crud is 1.0–3.0:1 in weight ratio, preferably 1.5–2.5:1.

If the mixing ratio of the frit to the crud is less than 1:1, the sintering process can not be satisfactorily effected and when said ratio is greater than 3:1, the porosity of the sintered body becomes higher and the radioactive substances are leaked or diffused.

The following examples are given for the purpose of illustration of this invention and are not intended as limitations thereof.

EXAMPLE

A nonradioactive imitated sample having substantially the same composition as dry powdery crud containing a main component of ferric oxide, and tri-iron tetraoxide and a slight amount of Cobalt (Co), Manganese (Mn), Cesium (Cs) etc. was previously prepared and 1% of crud slurry was prepared by using this imitated crud sample. The slurry was concentrated by adding 0.5 ppm of nonionic high molecular flocculant (made by Diyalock Co. NP-800) thereto and then the crud concentration was controlled to 30%. The thus controlled slurry was dried to obtain a dry crud. Aluminum phosphate series of frit consisting of 10.7% by weight of $Al_2O_3$, 34.8% by weight of $B_2O_3$, 11.2% by weight of $Na_2O$, 31.8% by weight of $P_2O_5$ and 11.5% by weight of other substances and having a softening temperature of 440° C. was added to the above described crud in the amount as shown in the following Table 2 to prepare a mixture. The obtained mixture was charged in a steel can having a diameter size of of 100 mm and a height of 150 mm and pressed therein so as to become about 80% by volume. The steel can filled with the mixture was heated under the heating conditions described in the following Table 2 to sinter and solidify the imitated crud powder. Then, a non-shrinkable cement was charged onto a surface of the solidified body in the steel can, and the surface of the solidified body was completely sealed to complete the solidifying treatment. The bulk density, compression strength, Cs diffusion coefficient and the like of this solidified body were measured. The obtained results are shown in Table 2. For comparison, a solidified body was prepared by solidifying the imitated crud with a cement and the measurement was effected as a comparative sample.

As seen from the results of Table 2, the solidified bodies obtained by the treating process for solidification of the present invention have a high compression strength and an amount of Cs leaked is very small. It has been confirmed that said process is excellent in the aspect of safety.

As mentioned above, the present invention is a process for treating a radioactivated crud formed in the cooling water system of a reactor, for which a treating process has never been heretofore established. The result is a safe and sure solidified body and is an optimum process for treating crud formed and stored in nuclear power plants and is a very useful process for treating radioactive wastes in view of present industry needs and to prevent environmental pollution. While the present invention has been described in its preferred embodiments, it is to be understood that the invention is not limited thereto but may be otherwise embodied within the scope of the following claims.

TABLE 2

| | | Mixing Ratio | Heating condition Temperature (°C.) | Heating condition Time (hr) | Bulk density g/cm³ | Compression strength kg/cm² | Cs diffusion coefficient cm²/day |
|---|---|---|---|---|---|---|---|
| | | Clad:Frit | | | | | |
| Present invention | 1 | 1:1 | 650 | 15 | 2.42 | 650 | $5.0 \times 10^{-5}$ |
| | 2 | 1:1 | 650 | 15 | 2.38 | 660 | $5.0 \times 10^{-5}$ |
| | 3 | 1:1.5 | 650 | 15 | 2.46 | 830 | $1.1 \times 10^{-5}$ |
| | 4 | 1:1.5 | 650 | 15 | 2.49 | 870 | $1.1 \times 10^{-5}$ |
| | 5 | 1:1.5 | 650 | 20 | 2.53 | 900 | $1.1 \times 10^{-5}$ |
| | 6 | 1:2 | 650 | 15 | 2.47 | 880 | $1.5 \times 10^{-6}$ |
| | 7 | 1:2 | 650 | 15 | 2.48 | 900 | $1.5 \times 10^{-6}$ |
| | 8 | 1:2 | 650 | 20 | 2.51 | 920 | $1.5 \times 10^{-6}$ |
| | 9 | 1:2.5 | 650 | 15 | 2.47 | 1020 | $1.0 \times 10^{-6}$ |
| | 10 | 1:3 | 650 | 15 | 2.46 | 1050 | $9.0 \times 10^{-7}$ |
| | | Clad:Cement | | | | | |
| Comparative sample | | 1:1.5 | — | — | 2.03 | 130 | $5.0 \times 10^{-3}$ |
| | | 1:3 | — | — | 2.00 | 210 | $4.0 \times 10^{-3}$ |

What is claimed is:

1. A process for treating a radioactive waste through solidification, which comprises (i) adding a nonionic high molecular flocculant to a slurry containing a radioactivated crud to precipitate the crud, concentrating the thus treated slurry and separating the crud from the slurry, (ii) drying said crud, mixing the dried crud with a frit of a low melting point having a softening temperature of less than 500° C. and filling a steel can with the resulting mixture, (iii) heating the steel can to effect sintering to solidify said resulting mixture, and (iv) sealing a surface of the sintered body in the steel can with a sealing material.

2. The process of claim 1, wherein an amount of flocculant added is 0.3–1 ppm based on an amount of the slurry.

3. The process of claim 1, wherein an amount of the flocculant added is 0.5 ppm.

4. The process of claim 1, wherein a mixing ratio of the frit to the crud is 1.0–3.0:1 by weight.

5. The process of claim 2, wherein a mixing ratio of the frit to the crud is 1.0–3.0:1 by weight.

6. The process of claim 1, wherein said mixing ratio is 1.5–2.5:1 by weight.

7. The process of claim 2, wherein said mixing ratio is 1.5–2.5:1 by weight.

8. A process for treating a radioactive waste through solidification, comprising:

adding a nonionic high molecular flocculant to a slurry containing a radioactivated crud to precipitate the crud, concentrating the thus treated slurry and separating the crud from the slurry;

drying said crud, mixing the dried crud with a frit of a low melting point having a softening temperature of less than 500° C. and filling the resulting mixture in a steel can;

heating the steel can to effect sintering of said resulting mixture, said sintering occurring at a temperature between 500°–800° C. for a period of time between 2–20 hours, to obtain a solidified body; and sealing a surface of the sintered body in the steel can with a sealing material.

9. The process of claim 8, wherein said sintering occurs at a temperature between 600°–700° C.

10. The process of claim 8, wherein said period of time is between 15–20 hours.

11. The process of claim 8, wherein an amount of flocculant added is 0.3–1 ppm based on an amount of the slurry.

12. The process of claim 8, wherein an amount of flocculant added is 0.5 ppm.

13. The process of claim 8, wherein a mixing ratio of the frit to the crud is 1.0–3.0:1 by weight.

14. The process of claim 11, wherein a mixing ratio of the frit to the crud is 1.0–3.0:1 by weight.

15. The process of claim 8, wherein said mixing ratio is 1.5–2.5:1 by weight.

16. The process of claim 11, wherein said mixing ratio is 1.5–2.5:1 by weight.

17. The process of claim 1, wherein said nonionic high molecular flocculant is selected from a polyacrylamide series of flocculants.

18. A process for treating a radioactive waste through solidification, comprising:

adding a flocculant selected from a polyacrylamide series of flocculants to a slurry containing a radioactivated crud to precipitate the crud, concentrating the thus treated slurry and separating the crud from the slurry;

drying said crud, mixing the dried crud with a frit of a low melting point having a softening temperature of less than 500° C. and filling the resulting mixture in a steel can;

heating the steel can to effect sintering of said resulting mixture, said sintering occurring at a temperature between 500°–800° C. for a period of time between 2–20 hours, to obtain a solidified body; and sealing a surface of the sintered body in the steel can with a sealing material.

* * * * *